US009272855B2

(12) United States Patent
Yamazaki

(10) Patent No.: US 9,272,855 B2
(45) Date of Patent: Mar. 1, 2016

(54) PAPER-SHEET STACKING APPARATUS

(71) Applicant: Kabushiki Kaisha Toshiba, Tokyo (JP)

(72) Inventor: Hirofumi Yamazaki, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/198,813

(22) Filed: Mar. 6, 2014

(65) Prior Publication Data

US 2014/0284873 A1 Sep. 25, 2014

(30) Foreign Application Priority Data

Mar. 21, 2013 (JP) ..... 2013-058807

(51) Int. Cl.

*B65H 29/38* (2006.01)
*B65H 1/02* (2006.01)
*B65H 31/06* (2006.01)

(52) U.S. Cl.

CPC ..... *B65H 1/025* (2013.01); *B65H 31/06* (2013.01); *B65H 2402/541* (2013.01); *B65H 2511/152* (2013.01); *B65H 2515/30* (2013.01); *B65H 2701/1916* (2013.01)

(58) Field of Classification Search

CPC ..... B65H 2301/421; B65H 2301/4214; B65H 2301/42146; B65H 2301/4223; B65H 35/00; B65H 31/26; B65H 31/06

USPC ..... 271/177, 178, 179, 200, 201, 213, 214

See application file for complete search history.

(56) References Cited

U.S. PATENT DOCUMENTS

| | | | | | |
|---|---|---|---|---|---|
| 3,078,089 | A * | 2/1963 | Maidment | 271/179 |
| 3,452,983 | A * | 7/1969 | Wood et al. | 271/214 |
| 3,659,841 | A | 5/1972 | Rigotti | |
| 5,221,080 | A * | 6/1993 | Ricciardi | 271/214 |
| 5,253,859 | A * | 10/1993 | Ricciardi | 271/176 |
| 6,588,743 | B2 * | 7/2003 | Yap | 271/214 |
| 7,845,484 | B2 * | 12/2010 | Zimmermann | 198/347.1 |

FOREIGN PATENT DOCUMENTS

| | | | |
|---|---|---|---|
| DE | 10 2007 050185 | B3 | 2/2009 |
| GB | 2283733 | A | 5/1995 |
| JP | 2003-034445 | A | 2/2003 |
| JP | 2003-306264 | A | 10/2003 |

OTHER PUBLICATIONS

Extended European Search Report issued in related European Patent Application No. 14157813.8 mailed Jun. 20, 2014, 6 pages.

* cited by examiner

*Primary Examiner* — Thomas Morrison
(74) *Attorney, Agent, or Firm* — Baker Botts L.L.P.

(57) ABSTRACT

According to one embodiment, a paper-sheet stacking apparatus includes a holding unit, a pushing mechanism, a backup, and a variable-force spring mechanism. The holding unit has a stacking base for holding a plurality of paper sheets in standing position and is configured to stack the paper sheets, one laid on another in a direction of a plane. The pushing mechanism is configured to push paper sheets transported, into the holding unit. The backup opposed to the pushing mechanism, is able to move in the direction the paper sheets are stacked and is configured to hold any paper sheet stacked between the backup and the pushing mechanism and to move away from the pushing mechanism as paper sheets are stacked one after another.

6 Claims, 7 Drawing Sheets

PAPER-SHEET STACKING APPARATUS

CROSS-REFERENCE TO RELATED APPLICATIONS

This application is based upon and claims the benefit of priority from Japanese Patent Application No. 2013-058807, filed Mar. 21, 2013; the entire contents of which are incorporated herein by reference.

FIELD

The embodiments described herein relate generally to paper-sheet stacking apparatuses.

BACKGROUND

Paper-sheet stacking apparatuses are apparatuses that collect and stack, in a standing position, paper sheets such as mail items transported at high speed. Any apparatus of this type comprises a holding unit for holding paper sheets, a movable backup plate, a pushing roller and a supporting guide. The backup plate is arranged, touching the paper sheet that is an endmost sheet of the paper-sheet stack held in the holding unit. The backup plate moves in the direction the paper sheets are stacked, in accordance with the number of the paper sheets stacked, and therefore pushes the paper-sheet stack in the direction the paper sheets are stacked. The pushing roller is located at some distance from the backup plate and touches, in rolling contact, the other endmost paper sheet of the paper-sheet stack, cooperating with the backup plate to clamp the paper-sheet stack. The pushing roller receives the paper sheet next to the other endmost paper sheet, between it and the other endmost paper sheet, and then pushes the paper sheet next to the other endmost paper sheet into the end of the paper-sheet stack.

In recent years, paper sheets (document sheets) that can be processed in the paper-sheet processing apparatus such as a mail processing apparatus have been increasing in size. Further, these paper sheets are increasing in thickness, year by year. In the paper-sheet stacking apparatus described above, the pressure applied to the backup plate is constant, and the backup member may be flicked because of the weight of the paper-sheet stack when a thick paper sheet, for example, is fed, In this case, the thick paper sheet is pushed away, and cannot be stacked. To prevent this event, the pressured applied to the backup plate may be increased. If the pressure is increased, however, the pressure for stacking paper sheets will not be mitigated. As a result, the pressure the pushing roller applies to the paper-sheet stack rises, making it difficult to feed paper sheets onto the paper-sheet stack.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, a paper-sheet stacking apparatus includes a holding unit, a pushing mechanism, a backup, and a variable-force spring mechanism. The holding unit has a stacking base for holding a plurality of paper sheets in standing position and is configured to stack the paper sheets, one laid on another in a direction of a plane. The pushing mechanism is configured to push paper sheets transported, into the holding unit. The backup opposed to the pushing mechanism, is able to move in the direction the paper sheets are stacked and is configured to hold any paper sheet stacked between the backup and the pushing mechanism and to move away from the pushing mechanism as paper sheets are stacked one after another. The variable-force spring mechanism is configured to bias the backup toward the pushing mechanism, to apply a first spring force to the backup while the backup is moving from the pushing mechanism by a first distance in a paper-sheet stacking direction, and to apply a second spring force smaller than the first spring force to the backup while the backup is further moving by a second distance in the paper-sheet stacking direction.

Figure 1:
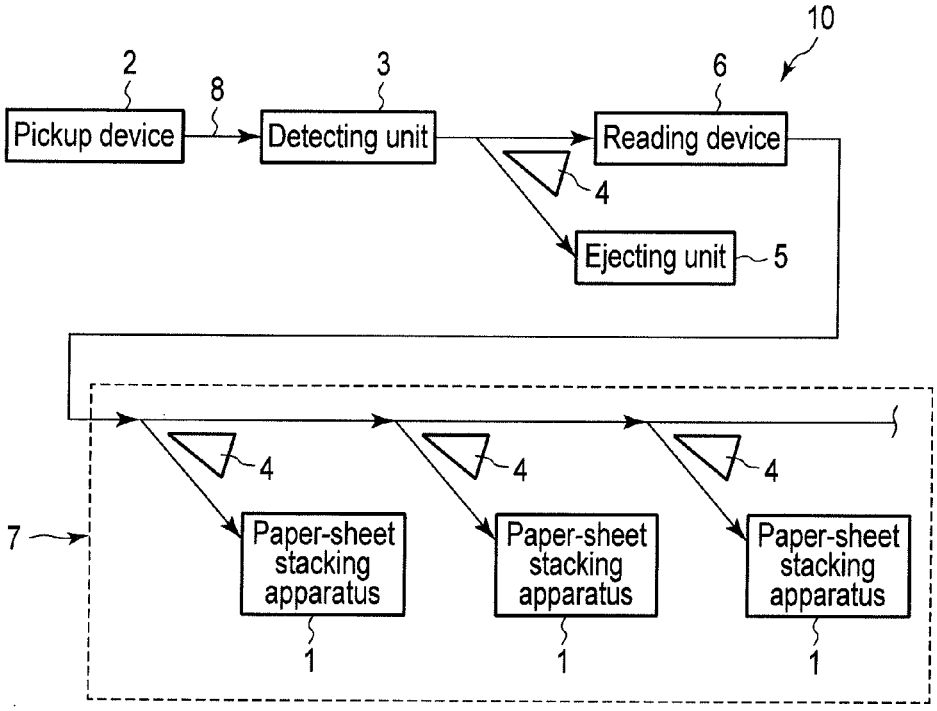
FIG. 1 is a block diagram schematically showing an exemplary paper-sheet processing apparatus comprising a paper-sheet stacking apparatus according to an embodiment.

FIG. 1 is a block diagram schematically showing an exemplary paper-sheet processing apparatus 10 including paper-sheet stacking apparatuses 1 (hereinafter referred to as stacking apparatuses 1) according to an embodiment. The paper-sheet processing apparatus 10 reads information, such as addresses, from a plurality of paper sheets P and then sorts and stacks the paper sheets, one after another. The paper-sheet processing apparatus 10 comprises a pickup device 2, a detecting unit 3, a sorting unit 4, an ejecting unit 5, a reading device 6, and a stacking unit 7. The stacking unit 7 has a plurality of paper-sheet stacking apparatuses 1. The paper sheets the paper-sheet processing apparatus 10 processes are mail items, but are not limited to mail items only.

Paper sheets P are set in the pickup device 2, one laid on another. The pickup device 2 picks up the paper sheets and feeds them, one by one to a transport path 8. Along the transport path 8, a plurality of endless transport belts (not shown) extend, two belts of each pair positioned to sandwich the transport path 8. Thus, the paper sheets P are transported, each held between two transport belts. The paper sheets P picked up onto the transport path 8 are transported, one after another, to the detecting unit 3. The detecting unit 3 detects any overlap of paper sheets P, short gaps between paper sheets P, and the thickness and height of each paper sheet P. Any paper sheet P irregular in dimensions is sorted out by the sorting unit 4 and transported to the ejecting unit 5. The other paper sheets P, i.e., sheets having regular dimensions, pass through the sorting unit 4 to the reading device 6 located downstream. The reading unit 6 reads information, such as an address, from each paper sheet P. From the information the reading unit 6 has read, a control unit (not shown) determines to which paper-sheet stacking apparatus 1 each paper sheet P should be sorted. The stacking unit 7 comprises a plurality of sorting units 4 and a plurality of paper-sheet stacking apparatuses 1. Each sorting unit 4 sorts paper sheets P in accordance with the information read by the reading unit 6. Each paper-sheet stacking apparatus 1 stacks the paper sheets P sorted by the sorting unit 6 associated with it. After passing through reading unit 6, the paper sheets P are sorted by the sorting units 4 in accordance with the information read from them. The paper sheets P sorted by any sorting unit 4 are stacked in the paper-sheet stacking apparatus 1 associated with the sorting unit 4.

Figure 2:
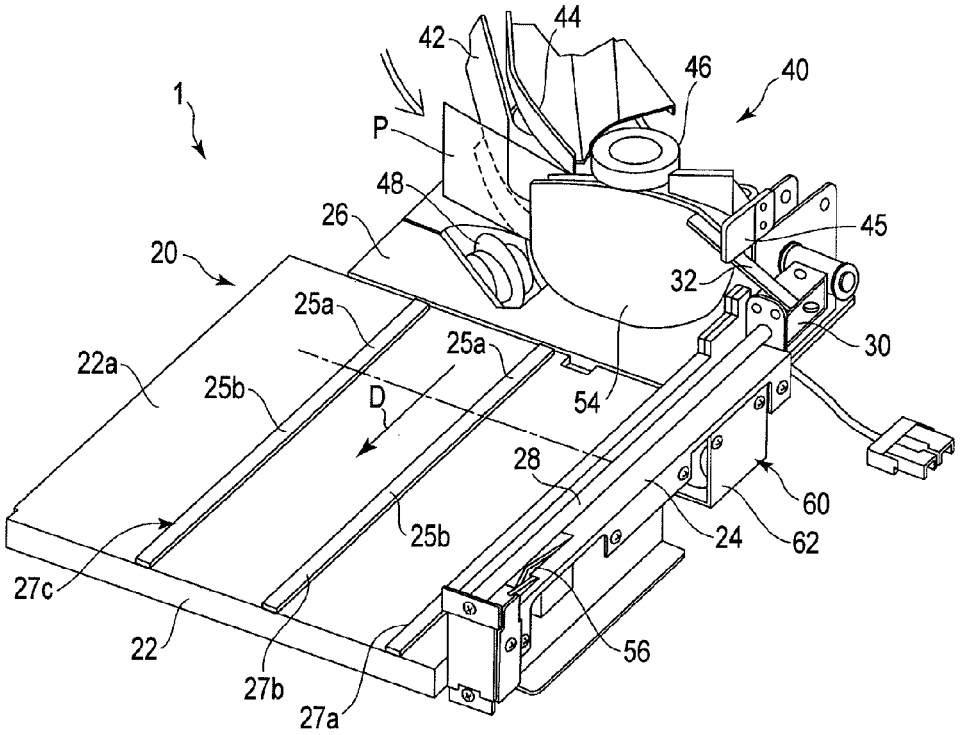
FIG. 2 is a perspective view of an example of the paper-sheet stacking apparatus.
Figure 3:
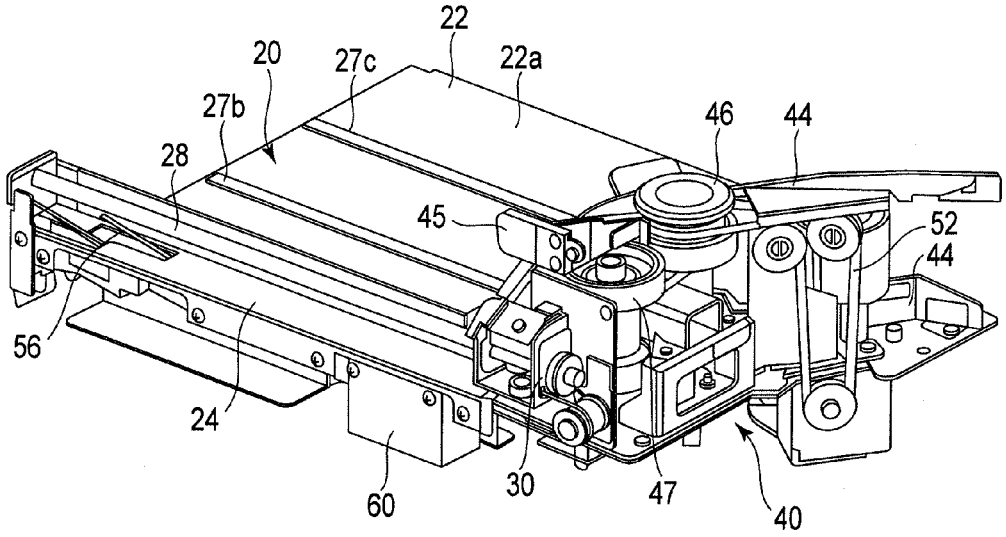
FIG. 3 is a perspective view of the example of the paper-sheet stacking apparatus, as seen in a direction different from the direction in which the apparatus is viewed in FIG. 2.
Figure 4:
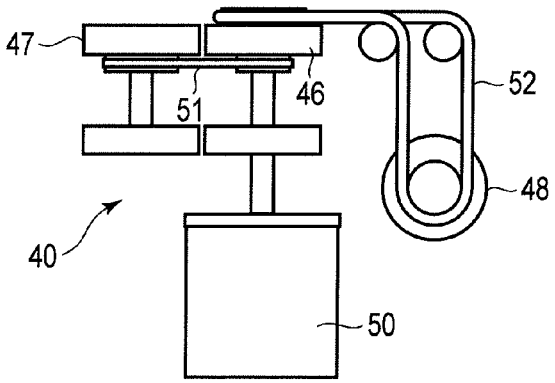
FIG. 4 is a side view of an example of the pushing mechanism incorporated in the paper-sheet stacking apparatus.
Figure 5:
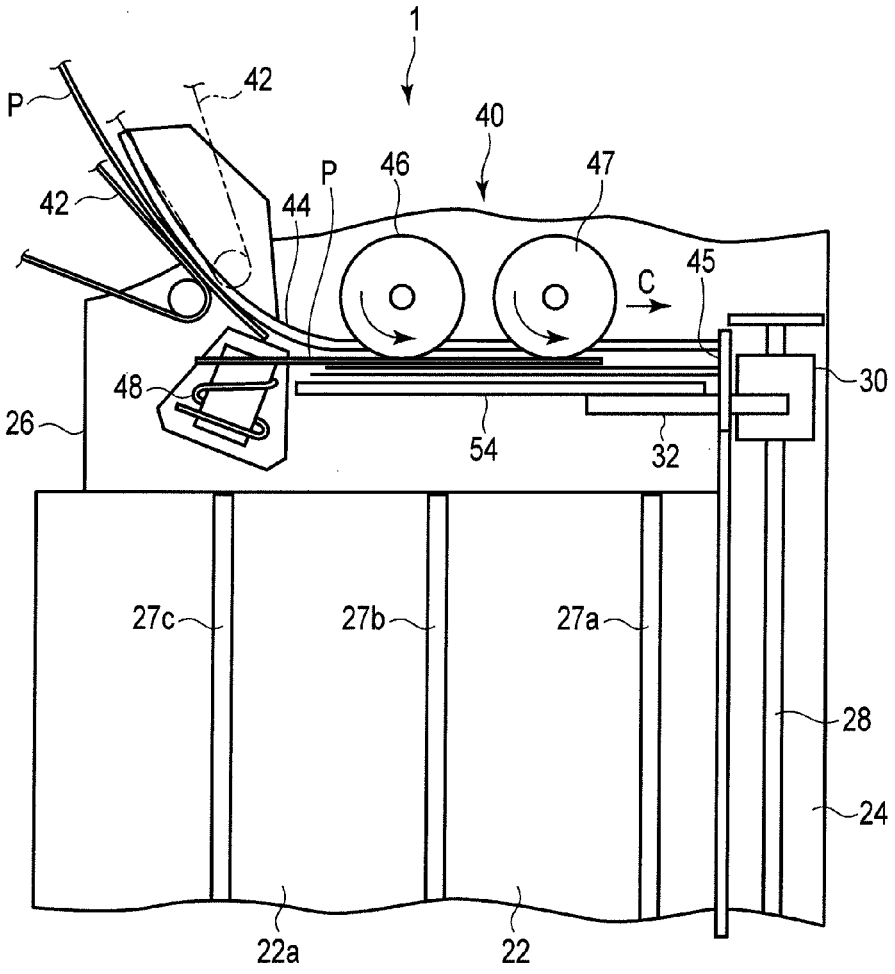
FIG. 5 is a plan view showing a part of the paper-sheet stacking apparatus.

The paper-sheet stacking apparatuses 1 will be described. FIG. 2 and FIG. 3 are perspective views of one paper-sheet stacking apparatus 1. FIG. 4 is a side view of an example of the pushing mechanism incorporated in the paper-sheet stacking apparatus 1. FIG. 5 is a plan view showing a part of the paper-sheet stacking apparatus 1.

As shown in FIG. 2 to FIG. 5, the paper-sheet stacking apparatus 1 comprises a holding unit 20, a pushing mechanism 40, a movable backup plate (backup or stacking paddle) 54, and a variable-force spring mechanism 60. The holding unit 20 is configured to hold a plurality of paper sheets P in standing position. The pushing mechanism 40 is configured to push paper sheets P sorted into the holding unit 20, stacking them one after another in the holding unit 20. The backup plate 54 is opposed to the pushing mechanism 40, in the holding unit 20, and configured to hold the paper sheets P stacked, in a gap between it and the pushing mechanism 40. The variable-force spring mechanism 60 biases the backup plate 54 toward the pushing mechanism 40 and the stacked paper sheets P.

The holding unit 20 has a stacking base (bottom wall) 22 and a side wall 24. The stacking base 22 is an almost rectangular plate on which a plurality of paper sheets P pushed by the pushing mechanism 40 are mounted in standing position, one overlapping another. The side wall 24 is positioned to contact the front side, either shorter or longer, of any paper sheet P transported to the holding unit 20. The upper surface of the stacking base 22 constitutes a support surfaced 22*a* that is almost horizontal. The side wall 24 stands almost vertical to the support surfaced 22*a*. The side wall 24 is provided, extending along one side of the support surfaced 22*a* in paper-sheet stacking direction D in the holding unit 20. At the entrance side of the stacking base 22, an entrance base 26 having a flat surface is provided. The entrance base 26 is positioned one step above the stacking base 22.

From the support surface 22*a*, guide ribs, for example three guide ribs 27*a*, 27*b* and 27*c*, protrude to decrease the friction between the sheet papers P stacked and the support surfaced 22*a*. Each of the guide ribs 27*a*, 27*b* and 27*c* extends straight from the entrance side of the support surfaced 22*a* to the side thereof, which is opposite in the paper-sheet stacking direction D. The support surfaced 22*a* of the stacking base 22 is positioned one step below the surface of the entrance base 26, and the upper ends of the guide ribs 27*a*, 27*b* and 27*c* are positioned in the same plane as the surface of the entrance base 26. The guide ribs 27*a*, 27*b* and 27*c*, which serve as support members and may contact paper sheets P, have a semicircular cross section.

Figure 6:
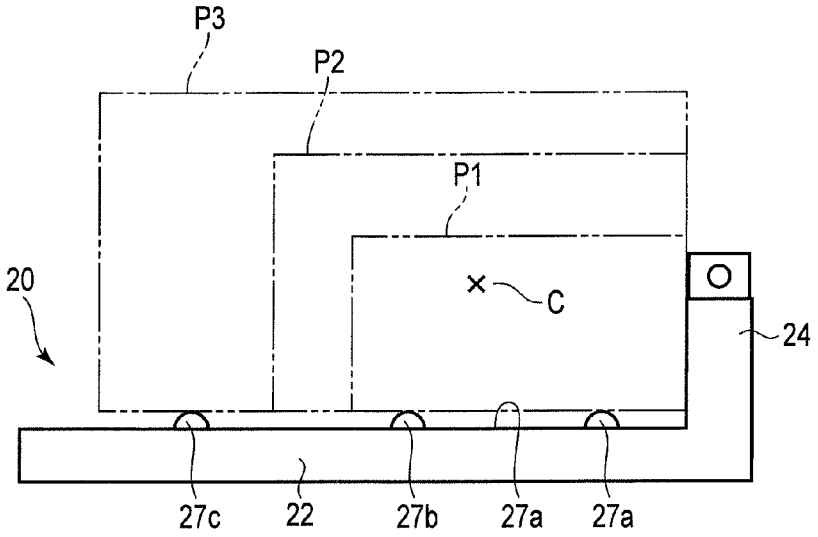
FIG. 6 is a side view schematically showing examples of the holding unit and guide rib of the paper-sheet stacking apparatus.

The three guide ribs 27*a*, 27*b* and 27*c* are arranged, one spaced apart from another in the direction orthogonal to the side wall 24. As shown in FIG. 6, the guide rib 27*a* located nearer the side wall 24 than any other guide ribs and the guide rib 27*a* next to the guide rib 27*a* are positioned to support a side part of the smallest paper sheet P1 and a side part of the medium-size paper sheet P2. Further, the intermediate guide rib 27*b* is located away from the center C of gravity of the medium-size paper sheet P2, or more spaced apart from the side wall 24 than the center C of gravity. The guide rib 27*c* most spaced apart from the side wall 24 is located to support a side parts of a large paper sheet P3.

As FIG. 2 shows, each of the guide ribs 27*a*, 27*b* and 27*c* is composed of first part 25*a* and second part 25*b*. The first part 25*a* (first-distance part, or initial stacking-phase part) extends from the end of the pushing mechanism 40 to the middle part thereof, as viewed in the lengthwise direction of the guide rib, and is made of a high-friction material such as aluminum. The second part 25*b* (second-distance part, or intermediate stacking-phase part) extends from the first part 25*a* to the other end of the guide rib, as viewed in the lengthwise direction of the guide rib, and is made of a material, such as Delrin, having a smaller coefficient of friction than the high-friction material.

As shown in FIG. 2 to FIG. 5, the pushing mechanism 40 comprises a plurality of transport belts 42, a transport guide 44, a pair of pushing rollers 46 and 47, a feed screw 48, and a drive motor 50 configured to drive the feed screw 48. The pushing mechanism 40 is provided at the entrance base 26 of the holding unit 20.

The transport guide 44 is arranged, extending from the front side of the paper sheet P to the side wall 24, over the sheet-stacking position in the holding unit 20. A stopper 45 is provided at the downstream end of the transport guide 44, and is almost aligned with the side wall 24 of the holding unit 20. The transport belts 42 are arranged, extending along the upstream end of the transport guide 44, and are configured to pinch any paper sheet P sorted and transport the same toward a stacking position. The pushing rollers 46 and 47 are located adjacent, opposed to each other, at a sheet-stacking position. That is, the pushing rollers 46 and 47 are arranged, facing the backup plate 54 (later described). The pushing rollers 46 and 47 are arranged side by side, respectively, upstream and downstream in the direction paper sheets P are pushed. Both pushing rollers 46 and 47 are supported on the entrance base 26 and can rotate freely.

Figure 7:
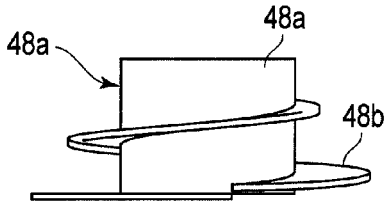
FIG. 7 is a plan view showing an example of the feeding screw incorporated in the pushing mechanism.

The feed screw 48 is supported in the entrance base 26 and can rotate, and is located upstream of the pushing roller 46 in the direction paper sheets P are pushed. As shown in FIG. 6 and FIG. 7, the feed screw 48 has a columnar shaft part 48*a* and a blade, or helical ridge 48*b*, which is formed on the outer circumferential surface of the shaft part 48*a*. The helical ridge 48*b* defines a screw having a pitch of 15 mm. The shaft part 48*a* has a groove 48*c* in one end, imparting good rotation balance to the feed screw 48.

As FIG. 2 to FIG. 5 show, the drive motor 50 has its shaft coupled to the pushing roller 46, and directly drives the pushing roller 46. A drive belt 51 is wrapped around the pushing rollers 46 and 47, and a drive belt 52 is wrapped around the pushing roller 46 and the feed screw 48. Thus, the dive force of the drive motor 50 is transmitted to the pushing roller 47 and feed screw 48. The pushing roller 47 and feed screw 48 are thereby rotated.

In the pushing mechanism 40 so configured as described above, any paper sheet P that is fed, while held by the transport belts 42, is released at the entrance to the holding unit 20. The paper sheet P is then transported along the transport guide 44, and enters the nip between the backup plate (later described) and the pushing rollers 46 and 47. The paper sheet P is further fed in transport direction C, by the drive force of the pushing rollers 46 and 47 rotating in the forward direction. The pushing roller 47 positioned downstream rotates at a lower speed than the pushing roller 46 positioned upstream, decelerating the paper sheet P fed to the pushing roller 47. The paper sheet P eventually abuts, at its front side, on the stopper 45, and stops at a stacking position. The stopper 45 is made of a material that can absorb the impact the paper sheet P receives while transported, for example an elastic material (e.g., rubber or gel).

As the paper sheet P passes over the feed screw 48, the helical ridge 48*b* of the feed screw 48 pushes the rear side of the paper sheet P in the rotation direction of the helical ridge 48*b*, namely toward the pushing roller 46, while the paper sheet P is being transported toward the pushing roller 46. This opens the entrance passage for the next paper sheet P, ultimately accomplishing continuous stacking of paper sheets. The feed screw 48 has a pitch of 15 mm in this embodiment, enabling the paper-sheet stacking apparatus 1 to process a paper-sheet bundle having a thickness of 12.7 mm at most. Further, the rotation speed of the feed screw 48 can be increased, thereby to process thin paper sheets.

As specified above, the pushing mechanism 40 feeds paper sheets P, one after another, each in standing position, to the stacking position in the holding unit 20A. In the holding unit 20A, the paper sheets P are thereby continuously stacked in the direction D.

As shown in FIGS. 2, 3 and 5, the holding unit 20 has a backup plate (backup) 54. The backup plate 54 is, for example, a rectangular plate, and is opposed to the pushing rollers 46 and 47 of the pushing mechanism 40. More specifically, the backup plate 54 extends almost vertically to the support surfaced 22*a* of the stacking base 22 and to the side wall 24 of the holding unit 20A, and is supported to move in the paper-sheet stacking direction D. Above the side wall 24, a guide rail 28 extends parallel to the paper-sheet stacking direction D. The guide rail 28 supports a slider 30, which can slide along the guide rail 28. The slider 30 is coupled by a coupling arm to the backup plate 54. The backup plate 54 is therefore supported on the slider 30, and can move back and forth in the paper-sheet stacking direction D.

The backup plate 54 is biased by the variable-force spring mechanism 60 toward the pushing rollers 46 and 47, holding the stacked paper sheets P in the gap between the pushing rollers 46 and 47. As more and more paper sheets are stacked, the backup plate 54 moves together with the slider 30 along guide rail 28, parallel to the paper-sheet stacking direction D.

Figure 8:
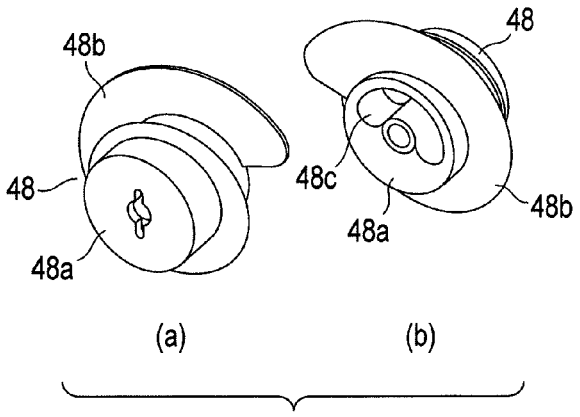
FIG. 8 is a perspective view showing another example of the feeding screw.
Figure 9:
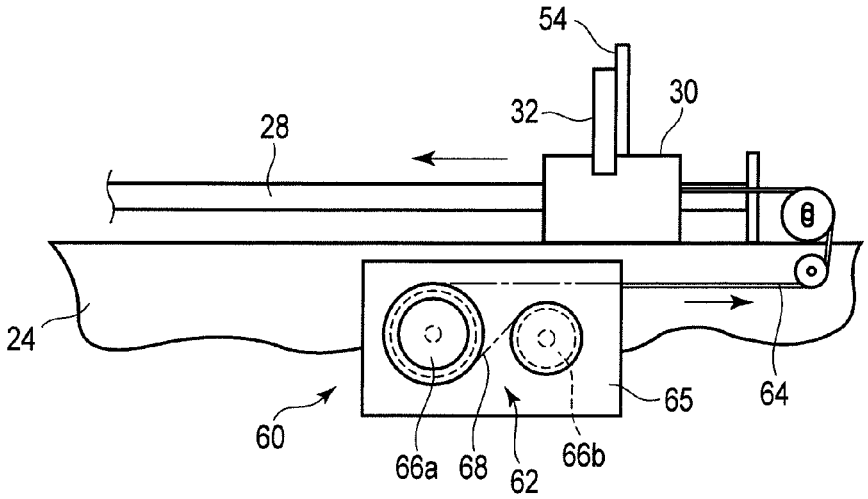
FIG. 9 is a side view showing the guide mechanism and variable-force spring mechanism of the paper-sheet stacking apparatus.
Figure 10:
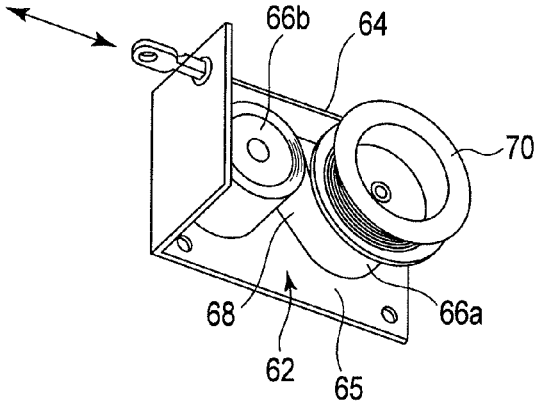
FIG. 10 is a perspective view showing an example of the variable-force spring mechanism.

As shown in FIG. 2, FIG. 3 and FIG. 8, the variable-force spring mechanism 60 has a variable-force spring (Conston spring, trademark) 62 and a coupling wire 64. The Conston spring 62 is mounted on the side wall 24 of the holding unit 20. The coupling wire 64 couples the variable-force spring 61 to the slider 30. As shown in FIG. 8 and FIG. 9, the variable-force spring 62 has a plate-like support frame 65, a first pulley 66*a*, a second pulley 66*b*, and an elongate leaf spring 68. The first and second pulleys 66*a* and 66*b* are secured to the support frame 65 and can rotate. The leaf spring 68 is a spiral strip having a thickness, width or hardness that gradually changes from the middle part, and therefore has a spring force that gradually changes toward one end.

A third pulley 70 is secured to the first pulley 66*a* and rotates together with the first pulley 66*a*. The coupling wire 64 is wound around the third pulley 70. The coupling wire 64 is led from the third pulley 70, passes through a through hole made in the support frame 65, is wrapped around a guide roller 74 secured to the side wall 24, and is coupled to the slider 30. As the coupling wire 64 is led from the third pulley 70, the third pulley 70 and first pulley 66*a* rotate, whereby the leaf spring 68 is taken up around the first pulley 66*a* and fed from the second pulley 66*b*. As a result, the leaf sprint 68 generates a rewinding spring force, which is applied to the slider 30 through the coupling wire 64. Thus, the variable-force spring 62 applies the spring force to the slider 30 and backup plate 54, biasing the backup plate 54 toward the pushing rollers 46 and 47. As the slider 30 and the backup plate 54 move in the paper-sheet stacking direction D, the coupling wire 64 is further led out. The variable-force spring 62 therefore biases the backup plate 54 via the coupling wire 64.

Figure 11:
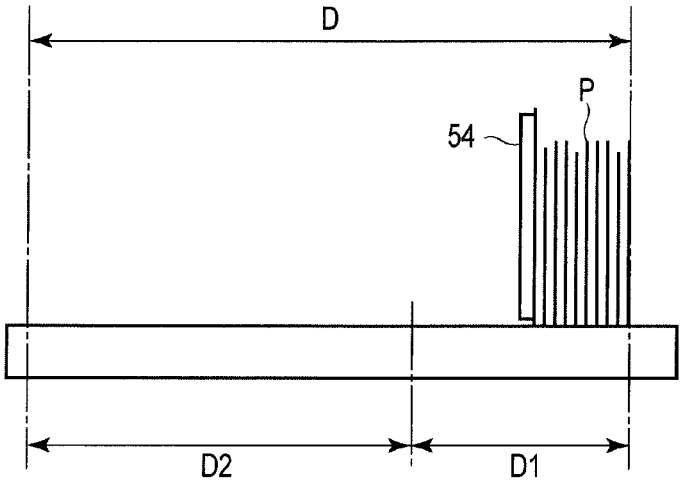
FIG. 11 is a diagram showing how paper sheets are stacked in the paper-sheet stacking apparatus.
Figure 12:
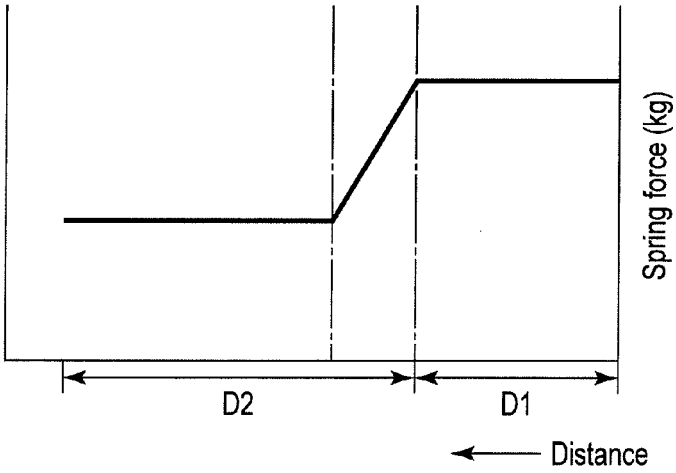
FIG. 12 is a graph showing an exemplary relation the number of paper sheets stacked has with the spring load (i.e., spring force) in the paper-sheet stacking apparatus.

As shown in FIG. 11 and FIG. 12, the backup plate 54 may move by stroke D. In this case, the variable-force spring 62 biases the backup plate 54 with a first spring force (e.g., 700 g), while the backup plate 54 is moving from the initial position, i.e., the stacking position, for first distance D1 in the paper-sheet stacking direction D. The backup plate 54 further moves for second distance D2 (=D−D1) in the paper-sheet stacking direction D, in the middle stacking-phase. While the backup plate 54 is so moving, it is biased with a second spring force (e.g., 500 g) smaller than the first spring force. The variable-force spring 62 may be so designed that its force gradually decreases from the first spring force to the second spring force.

As shown in FIG. 2 and FIG. 3, a fill-up detecting switch 56 is provided at the rear edge of the side wall 24. As more and more paper sheets P are stacked in the holding unit 20, the slider 30 slides, along with the backup plate 54, to the rear edge of the sidewall 24. When the slider 30 reaches a position near the fill-up position, it turns on the pre-switch of the fill-up detecting switch 56. As a result, an alarm device (not shown) is activated and a lamp (not shown) blinks, attracting the operator's attention. When the slider 30 further moves toward the rear edge of the side wall 24, the full switch of the fill-up detecting switch 56 is turned on, detecting the full state of the holding unit 20, stopping the stacking of paper sheets. Note that in the holding unit 20 of the paper-sheet stacking apparatus 1, the paper sheets P coming to the paper-sheet stacking apparatuses 1 are transported into an overflow holding unit (not shown).

In the paper-sheet stacking apparatuses 1 configured as described above, the variable-force spring mechanism 60 biases the backup plate 54 toward the pushing rollers, keeping the paper sheets P in a stacked state, while accumulated in the holding unit 20. In the initial stacking-phase, the spring load on the backup plate 54 is increased, preventing the backup plate 54 from being flicked by a thick or heavy paper sheet. Further, from the middle stacking-phase on, the spring load on the backup plate 54 is decreased, moderating the increase in the pressure the pushing rollers 46 and 47 apply to the paper sheets P being accumulated in the holding unit 20. Thus, the paper-sheet stacking apparatus 1 can stack paper sheets even if the sheets are of various types.

Moreover, of the guide ribs 27*a*, 27*b* and 27*c* provided on the stacking base 22, those parts that contact a paper sheet in the initial stacking-phase are made of a high-friction material, and those parts that contact a paper sheet in the middle stacking-phase are made of a low-friction material. Hence, a heavy paper sheet can be prevented from being flicked in the initial stacking-phase, and the pressure the backup plate applies to the paper sheet can be moderated from the middle stacking-phase on.

Further, since the pushing roller 46, which is coupled directly to the drive motor 50, can be stably rotatably driven, and does not stop even if the pressure the pressure the roller 46 applies to the paper sheet P increases as more and more paper sheets accumulate in the holding unit 20.

The invention can therefore provide a paper-sheet stacking apparatus that can stably stack paper sheets of various types.

The invention is not limited to the embodiment described above. For example, the number of sensors for detecting presence or absence of a paper sheet being transported is not limited to two. Three or more sensors may be used. Further, the transparent-medium sensor and paper sheet sensor, which constitute a first sensor, are not limited to reflection optical sensors and transmission optical sensors, and may be sensors of any other type. The time lag of the detection signal for identifying the transparent packaging medium can be set to any value, not based on the sampling cycle.

At least one embodiment described above can provide a paper-sheet stacking apparatus that can stack paper sheets stably.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper-sheet stacking apparatus comprising:

a holding unit having a stacking base for holding a plurality of paper sheets in standing position and configured to stack the paper sheets, one laid on another in a direction of a plane;

a pushing mechanism configured to push paper sheets transported, into the holding unit;

a backup opposed to the pushing mechanism, able to move a predetermined distance in the direction the paper sheets are stacked and configured to hold any paper sheet stacked between the backup and the pushing mechanism and to move away from the pushing mechanism as paper sheets are stacked one after another; and a variable-force spring mechanism coupled to the backup via a coupling wire and configured to bias the backup toward the pushing mechanism, to apply a first spring force to the backup via the coupling wire while the backup is moving from the pushing mechanism by a first distance of the predetermined distance in a paper-sheet stacking direction, and to apply a second spring force smaller than the first spring force to the backup via the coupling wire while the backup is further moving by a second distance of the predetermined distance in the paper-sheet stacking direction, wherein the stacking base has a flat support surface, guide ribs protruding from the support surface and configured to support a lower edge of the paper sheets, each extending straight from the pushing mechanism in the paper-sheet stacking direction; and of each guide rib, a part located with the first distance is made of a high-friction material, and a part located within the second distance is made of a low-friction material that offers less frictional resistance than the high-friction material.

2. The paper-sheet stacking apparatus according to claim 1, wherein the holding unit has a side wall which stands on the stacking base, which extends in the paper-sheet stacking direction and on which any paper sheet abuts when pushed by the pushing mechanism; a slider is coupled to the backup and supported on the sidewall and is able to move in the paper-sheet stacking direction; and the backup is supported by the slider.

3. The paper-sheet stacking apparatus according to claim 2, wherein the variable-force spring mechanism has a variable-force spring supported on the side wall and coupled to the slider.

4. The paper-sheet stacking apparatus according to claim 1, wherein the pushing mechanism comprises transport belts configured to transport paper sheets toward a stacking position, pushing rollers opposed to the backup at the stacking position and configured to push paper sheets toward the stacking position, and a feeding screw.

5. The paper-sheet stacking apparatus according to claim 2, wherein the pushing mechanism comprises transport belts configured to transport paper sheets toward a stacking position, pushing rollers opposed to the backup at the stacking position and configured to push paper sheets toward the stacking position, and a feeding screw.

6. The paper-sheet stacking apparatus according to claim 3, wherein the pushing mechanism comprises transport belts configured to transport paper sheets toward a stacking position, pushing rollers opposed to the backup at the stacking position and configured to push paper sheets toward the stacking position, and a feeding screw.

* * * * *